US008727074B1

(12) United States Patent
Bhajan

(10) Patent No.: US 8,727,074 B1
(45) Date of Patent: May 20, 2014

(54) PLATFORM ASSEMBLY

(71) Applicant: Heeralall Bhajan, Mississiauga (CA)

(72) Inventor: Heeralall Bhajan, Mississiauga (CA)

( * ) Notice: Subject to any disclaimer, the term of this patent is extended or adjusted under 35 U.S.C. 154(b) by 0 days.

(21) Appl. No.: 13/685,810

(22) Filed: Nov. 27, 2012

(51) Int. Cl.
*E06C 7/00* (2006.01)

(52) U.S. Cl.
USPC ..... 182/120; 248/238; 182/119

(58) Field of Classification Search
USPC ..... 182/119–122, 129; 248/210, 238
See application file for complete search history.

(56) References Cited

U.S. PATENT DOCUMENTS

| | | | | | |
|---|---|---|---|---|---|
| 2,432,206 | A | * | 12/1947 | Mott | 182/121 |
| 2,518,107 | A | * | 8/1950 | Wilson | 182/194 |
| 3,037,579 | A | * | 6/1962 | Barrow | 182/107 |
| 3,294,197 | A | * | 12/1966 | Kwiatkowski | 182/120 |
| 3,747,707 | A | * | 7/1973 | Fromlath et al. | 182/129 |
| 4,100,998 | A | | 7/1978 | Marquez | |
| 4,401,187 | A | * | 8/1983 | Van Patten | 182/121 |
| 4,880,079 | A | * | 11/1989 | Leclerc | 182/107 |
| 4,964,601 | A | * | 10/1990 | Dishman | 248/210 |
| 4,974,699 | A | * | 12/1990 | Boring | 182/107 |
| 5,056,620 | A | * | 10/1991 | Zumwalt et al. | 182/120 |
| 5,148,891 | A | * | 9/1992 | McConnell | 182/120 |
| 5,337,857 | A | | 8/1994 | Spalt et al. | |
| 5,484,036 | A | * | 1/1996 | Cothern | 182/107 |
| 5,603,405 | A | * | 2/1997 | Smith | 206/373 |
| 5,779,208 | A | | 7/1998 | McGraw | |
| 5,950,972 | A | * | 9/1999 | Irish | 248/210 |
| 5,971,101 | A | * | 10/1999 | Taggart | 182/129 |
| 6,663,072 | B1 | * | 12/2003 | Ritchey et al. | 248/444 |
| 6,685,069 | B2 | * | 2/2004 | Ladd | 224/265 |
| 6,786,300 | B1 | * | 9/2004 | Bonifacini | 182/120 |
| 6,849,056 | B1 | * | 2/2005 | Wiggins et al. | 602/21 |
| D523,156 | S | | 6/2006 | Skaggs | |
| 7,861,826 | B2 | * | 1/2011 | Meyers et al. | 182/121 |
| 2002/0002348 | A1 | * | 1/2002 | Wiggins et al. | 602/21 |
| 2007/0240935 | A1 | * | 10/2007 | O'Brien et al. | 182/120 |
| 2011/0297482 | A1 | * | 12/2011 | O'Brien et al. | 182/129 |

OTHER PUBLICATIONS

Definition of "lateral" provided in the Action Collins English Dictionary—Complete and Unabridged © HarperCollins Publishers 1991, 1994, 1998, 2000, 2003.*

Definition of "edge" provided in the Action The American Heritage® Dictionary of the English Language, Fourth Edition copyright © 2000 by Houghton Mifflin Company. Updated in 2009. Published by Houghton Mifflin Company. All rights reserved.*

Definition of "platform" provided in the Action Random House Kernerman Webster's College Dictionary, © 2010 K Dictionaries Ltd. Copyright 2005, 1997, 1991 by Random House, Inc. All rights reserved.*

* cited by examiner

*Primary Examiner* — Alvin Chin Shue
*Assistant Examiner* — Daniel Cahn

(57) ABSTRACT

A platform assembly includes a ladder that comprises a plurality of steps coupled to and extending between a pair of legs. A platform is provided that may be coupled to a selected one of the steps.

4 Claims, 6 Drawing Sheets

PLATFORM ASSEMBLY

BACKGROUND OF THE DISCLOSURE

Field of the Disclosure

The disclosure relates to platform devices and more particularly pertains to a new platform device for provider greater comfort on a ladder.

SUMMARY OF THE DISCLOSURE

An embodiment of the disclosure meets the needs presented above by generally comprising a ladder that comprises a plurality of steps coupled to and extending between a pair of legs. A platform is provided that may be coupled to a selected one of the steps.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
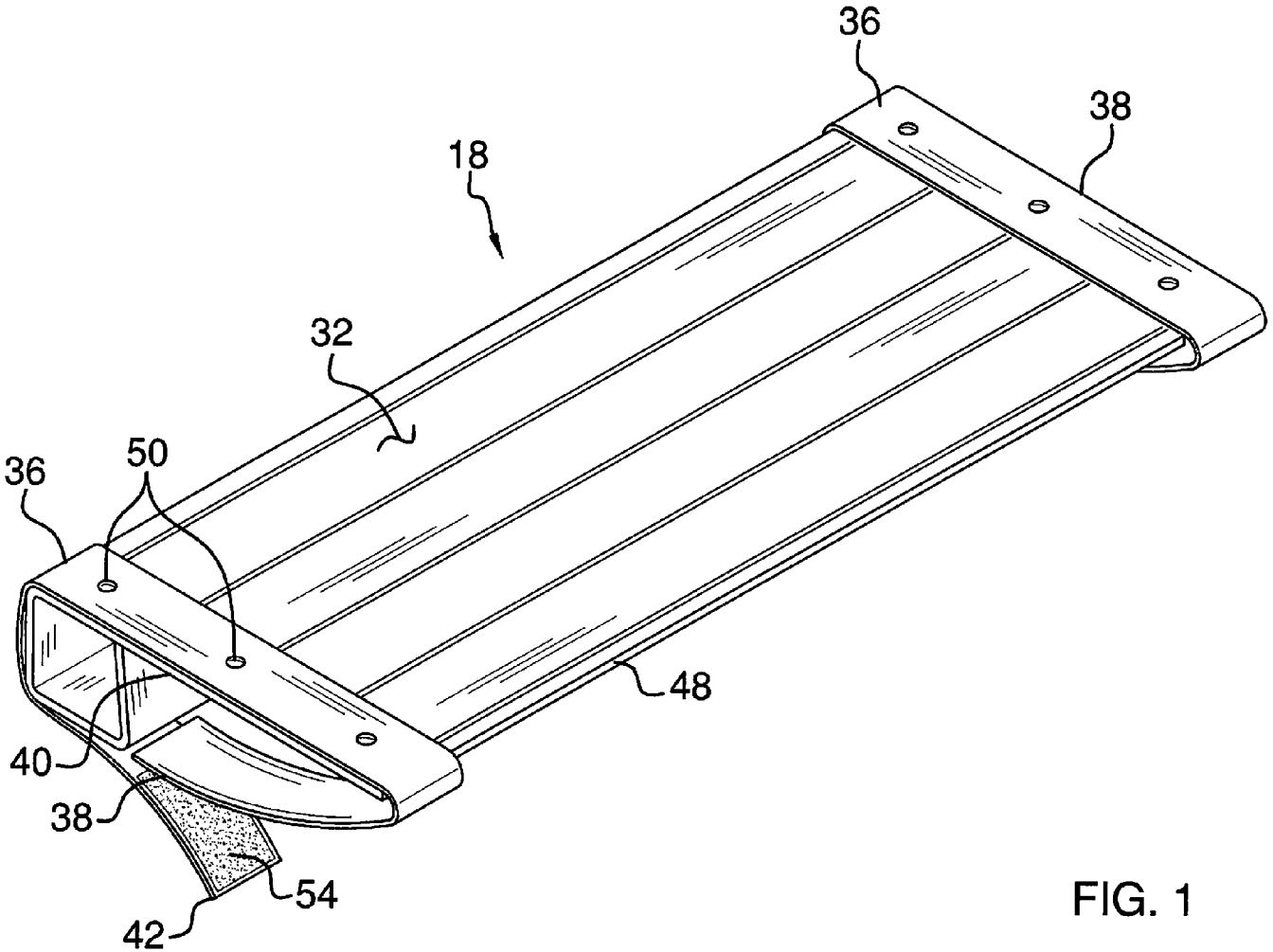
FIG. 1 is a perspective view of a platform assembly according to an embodiment of the disclosure.
Figure 2:
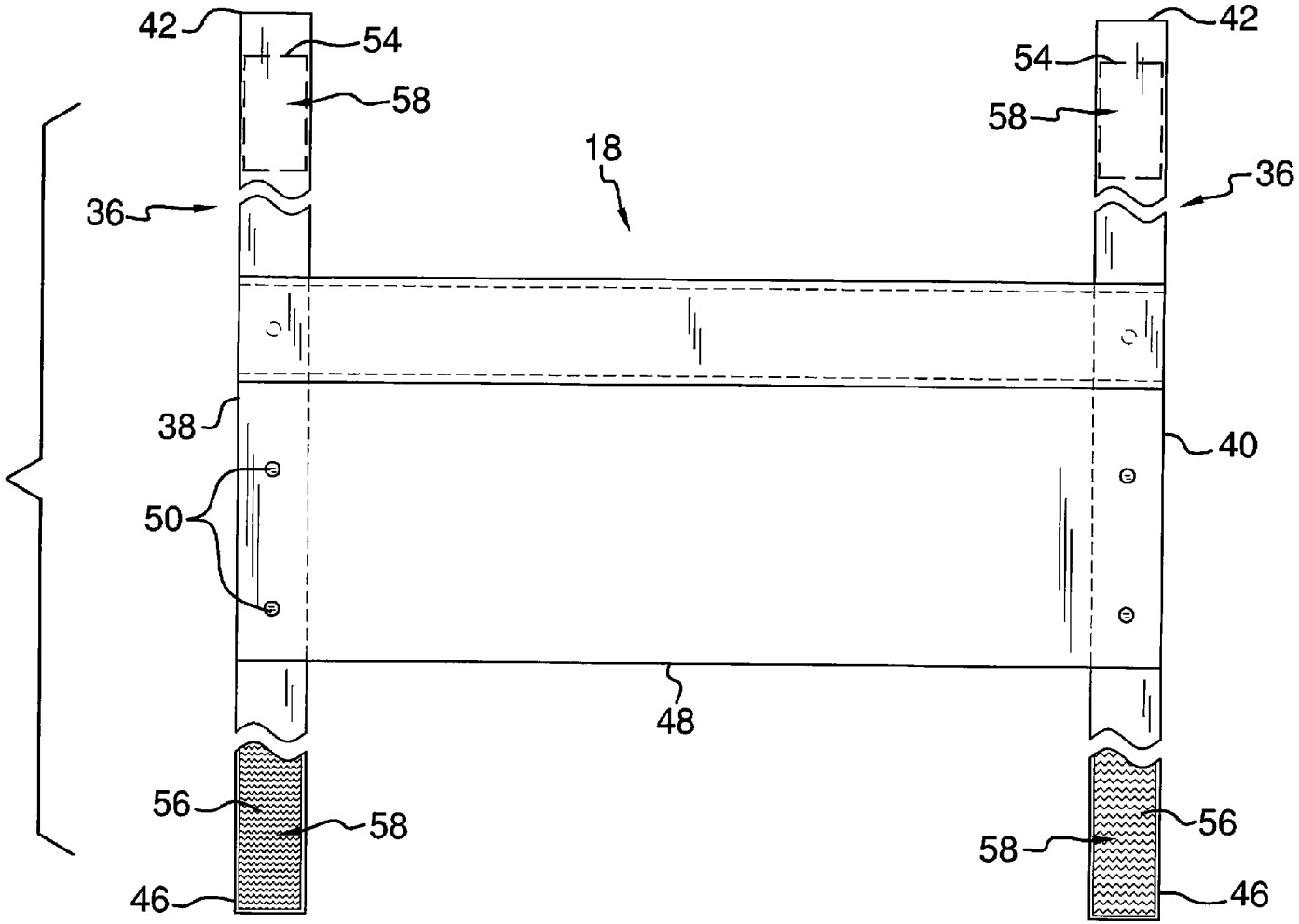
FIG. 2 is a bottom view of an embodiment of the disclosure.
Figure 3:
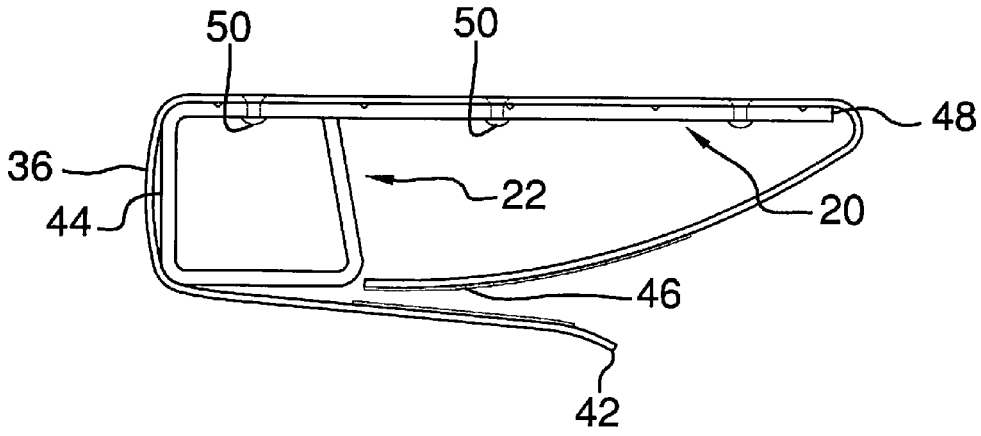
FIG. 3 is a right side view of an embodiment of the disclosure.
Figure 4:
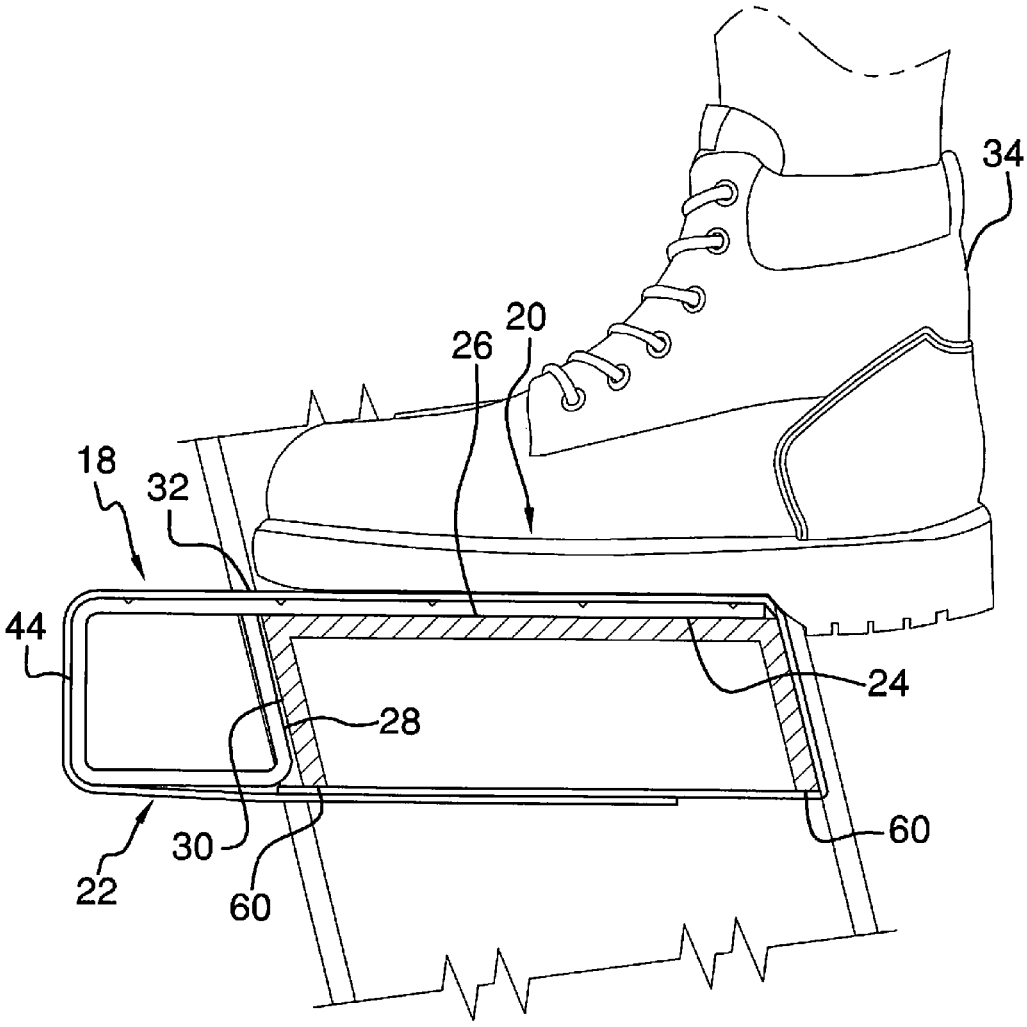
FIG. 4 is a cross sectional view taken along line 4-4 of FIG. 5 of an embodiment of the disclosure.
Figure 5:
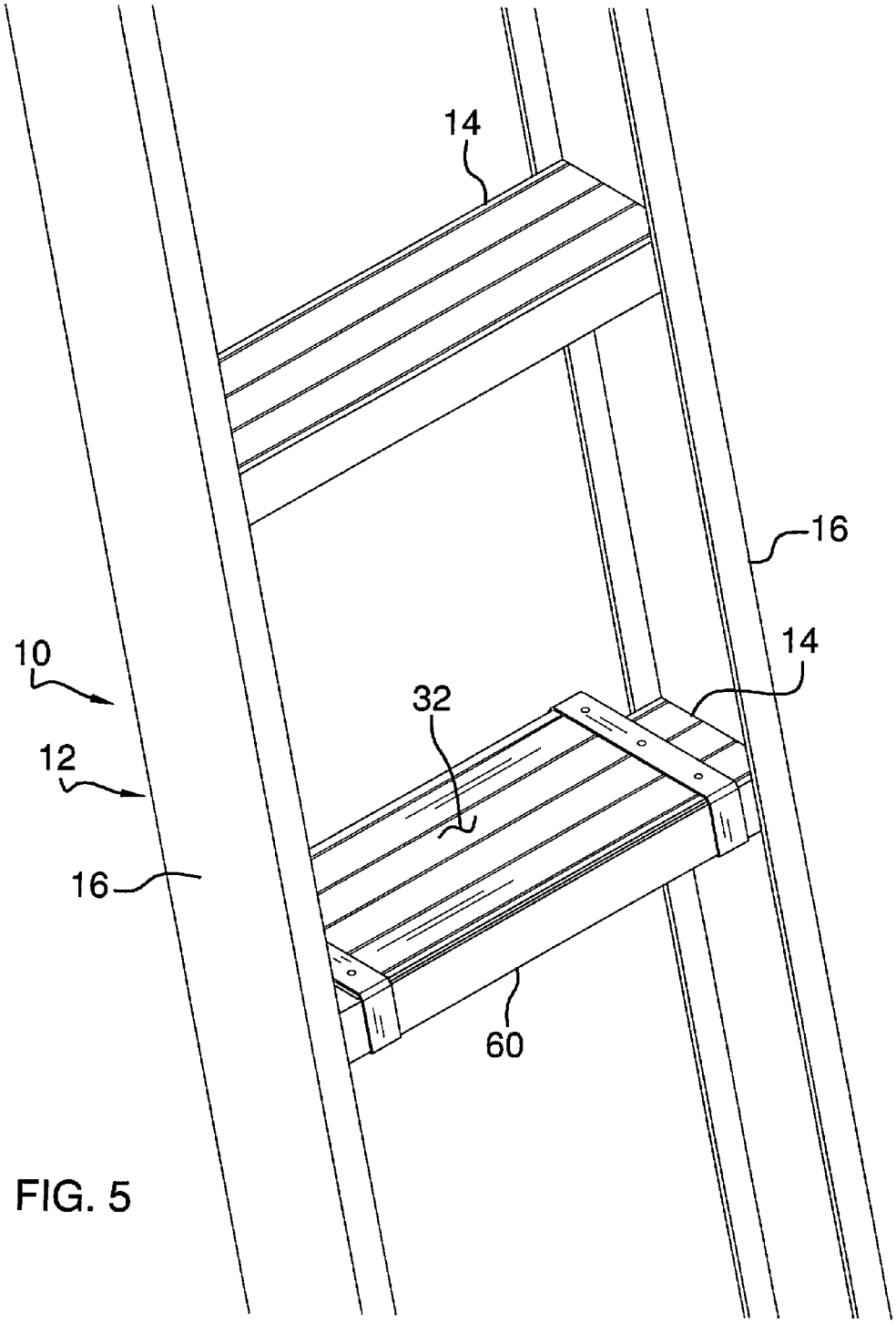
FIG. 5 is an in-use view of an embodiment of the disclosure.
Figure 6:
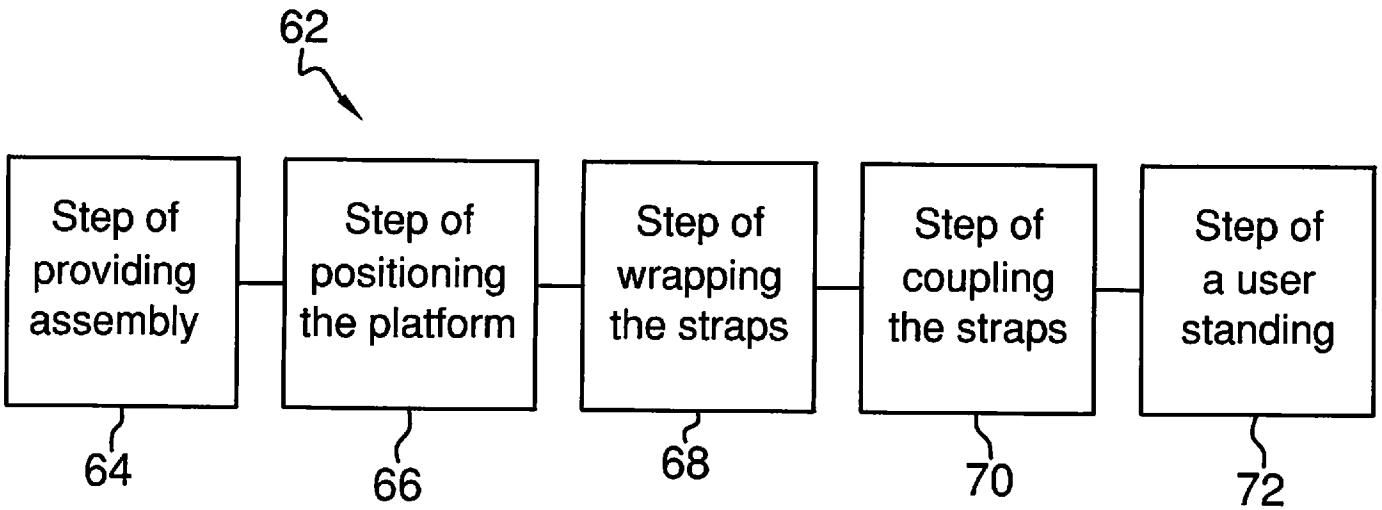
FIG. 6 is a schematic view of a method of utilizing an embodiment of the disclosure.

With reference now to the drawings, and in particular to FIGS. 1 through 6 thereof, a new platform device embodying the principles and concepts of an embodiment of the disclosure and generally designated by the reference numeral 10 will be described.

As best illustrated in FIGS. 1 through 6, the platform assembly 10 generally comprises a ladder 12 that comprises a plurality of steps 14 coupled to and extending between a pair of legs 16. The ladder 12 may be of any conventional design. A platform 18 comprises a flat portion 20 and a tubular portion 22. The platform 18 is positionable on a selected one of the steps 14 such that a bottom surface 24 of the flat portion 20 of the platform 18 coextensively abuts a top surface 26 of the step 14 and a front side 28 of the tubular portion 22 of the platform 18 coextensively abuts a back side 30 of the step 14.

A top surface 32 of the platform 18 may be textured to provide grip for a user 34. The platform 18 may have a width between 25 cm and 35 cm and a length between 15 cm and 30 cm.

A pair of straps 36 is coupled to the top surface 32 of the platform 18. A first strap of the pair of straps 36 is coextensive with an associated first lateral edge 38 of the platform and a second strap of the pair of straps 36 is coextensive with an associated second lateral edge 40 of the platform. A first end 42 of each of the straps 36 hangs freely from a rear side 44 of the tubular portion 22 of the platform 18. A second end 46 of each of the straps 36 hangs freely from a front edge 48 of the flat portion 20 of the platform 18. The first 42 and second 46 ends of each of the pair of straps 36 may extend below the platform 18 a distance between 10 cm and 20 cm. The pair of straps 36 includes a first strap and a second strap. A plurality of fasteners 50 extends through each of the straps 36 and engages the top surface 32 of the platform 18. The fasteners 50 may retain each of the straps 36 on the platform 18. The fasteners 50 may comprise rivets 52 of any conventional design.

A first coupler of a pair of first couplers 54 is coupled to the first end 42 of the first strap and a second coupler of the pair of first couplers 54 is coupled to the first end 42 of the second strap. A first coupler of a pair of second couplers 56 is coupled to the second end 46 of the first strap and a second coupler of the pair of second couplers 56 is coupled to the second end 46 of the second strap. The pair of second couplers 56 is complimentary to the pair of first couplers 54 so the first end 42 of each of the straps 36 may be coupled to the second end 46 of each of the straps 36. Each of the first 54 and second 56 couplers may comprise a hook and loop fastener 58.

Each of the first 42 and second 46 ends of each of the straps 36 may be wrapped around and coupled together beneath a bottom 60 of the selected one of the steps 14 after the platform 18 is positioned on the step 14. The pair of straps 36 may retain the platform 18 on the step 14 when the user 34 stands on the platform 18. The platform 18 may be coupled to the selected step 14 in order to increase a level of comfort for the user 34.

In use, a method 62 of coupling a platform 18 to a step 14 comprises the steps of providing 64 a ladder 12 comprising a plurality of steps 14 coupled to and extending between a pair of legs 16. A platform 18 has a flat portion 20 and a tubular portion 22. A pair of straps 36 is coupled to a top surface 32 of the platform 18. A first coupler 54 is coupled to a first end 42 of each of the straps 36 and a second coupler 56 is coupled to a second end 46 of each of the straps 36. The method 62 includes the step of positioning 66 the platform 18 on a selected one of the steps 14 such that a bottom surface 24 of the flat portion 20 of the platform 18 coextensively abuts a top surface 26 of the step 14 and a front side 28 of the tubular portion 22 of the platform 18 coextensively abuts a back side 30 of the step 14. The method 62 also includes the step of wrapping 68 each of the straps 36 around a bottom 60 of the selected one of the steps 14.

The method 62 further includes the step of coupling 70 each of the first 42 and second 46 ends of each of the straps 36 beneath the bottom 60 of the selected one of the steps 14. Additionally, the method 62 includes the step of a user standing 72 on a top surface 32 of the platform 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A platform assembly comprising:

a ladder comprising a plurality of steps coupled to and extending between a pair of legs; and a platform configured to be coupled to a selected one of said steps, said platform comprising a flat portion and a tubular portion, said platform being positionable on said selected one of said steps such that a bottom surface of said flat portion of said platform coextensively abuts a top surface of said selected one of said steps and a front side of said tubular portion of said platform coextensively abuts a back side of said selected one of said steps, an upper end of said front side of said tubular portion of said platform slanting inwardly toward a rear side of said tubular portion of said platform; and a pair of straps coupled to a top surface of said platform, a first strap of said pair of straps being coextensive with an associated first lateral edge of said platform and a second strap of said pair of straps being coextensive with an associated second lateral edge of said platform, a first end of each of said straps respectively capable of hanging freely from said rear side of said tubular portion of said platform, a second end of each of said straps respectively capable of hanging freely from a front edge of said flat portion of said platform; and a first coupler of a pair of first couplers being coupled to said first end of said first strap and a second coupler of said pair of first couplers being coupled to said first end of said second strap; and a first coupler of a pair of second couplers being coupled to said second end of said first strap and a second coupler of said pair of second couplers being coupled to said second end of said second strap, said pair of first couplers and said pair of second couplers being complimentary for coupling; and each of said first and second ends of each of said straps being wrapped around and coupled beneath a bottom of said selected one of said steps after said platform is positioned on said selected one of said steps, wherein said pair of straps is configured to retain said platform on said selected one of said steps to support a user.

2. The assembly according to claim 1, further comprising:

a plurality of fasteners extending through each of said straps and engaging said top surface of said platform, wherein said fasteners are configured to retain each of said straps to said platform.

3. A platform assembly comprising:

a ladder comprising a plurality of steps coupled to and extending between a pair of legs;

a platform comprising a flat portion and a tubular portion, said platform being positionable on a selected one of said steps such that a bottom surface of said flat portion of said platform coextensively abuts a top surface of said selected one of said steps and a front side of said tubular portion of said platform coextensively abuts a back side of said selected one of said steps, an upper end of said front side of said tubular portion of said platform slanting inwardly toward a rear side of said tubular portion of said platform;

a pair of straps coupled to a top surface of said platform, a first strap of said pair of straps being coextensive with an associated first lateral edge of said platform and a second strap of said pair of straps being coextensive with an associated second lateral edge of said platform, a first end of each of said straps capable of hanging freely from said rear side of said tubular portion of said platform, a second end of each of said straps capable of hanging freely from a front edge of said flat portion of said platform;

a plurality of fasteners extending through each of said straps and engaging said top surface of said platform, wherein said fasteners are configured to retain each of said straps to said platform;

a first coupler of a pair of first couplers being coupled to said first end of said first strap and a second coupler of said pair of first couplers being coupled to said first end of said second strap; and a first coupler of a pair of second couplers being coupled to said second end of said first strap and a second coupler of said pair of second couplers being coupled to said second end of said second strap, said pair of second couplers being complimentary to said pair of first couplers, wherein said first end of each of said straps is configured to be coupled to said second end of each of said straps, each of said first and second ends of each of said straps being wrapped around and coupled beneath a bottom of said selected one of said steps after said platform is positioned on said selected one of said steps, wherein said pair of straps is configured to retain said platform on said selected one of said steps to support a user.

4. A method of using a platform assembly, the method comprising:

providing the platform assembly of claim 1; and positioning said platform on said selected one of said steps such that said bottom surface of said flat portion of said platform coextensively abuts said top surface of said step and said front side of said tubular portion of said platform coextensively abuts said back side of said step; and wrapping each of said straps around said bottom of said selected on of said steps; and coupling each of said first and second ends of each of said straps beneath said bottom of said selected one of said steps; and standing on said top surface of said platform.

* * * * *